US012325972B2

(12) United States Patent
Albers et al.

(10) Patent No.: US 12,325,972 B2
(45) Date of Patent: Jun. 10, 2025

(54) CONTROL SYSTEM FOR ACTUATED PINS

(71) Applicant: Caterpillar Inc., Peoria, IL (US)

(72) Inventors: Riley A. Albers, Sugar Grove, IL (US); Jason P. Wigg, Ridgley (AU); Dennis W. Dicker, Devonport (AU); Rowan T. Franks, Penguin (AU); Robert A. Herold, Brimfield, IL (US); Steven R. Krause, Chillicothe, IL (US); Fuaad A. Sayeed, Dunlap, IL (US); Brodie L. Thompson, West Ulverstone (AU)

(73) Assignee: Caterpillar Inc., Peoria, IL (US)

( * ) Notice: Subject to any disclaimer, the term of this patent is extended or adjusted under 35 U.S.C. 154(b) by 460 days.

(21) Appl. No.: 17/712,907

(22) Filed: Apr. 4, 2022

(65) Prior Publication Data

US 2023/0313486 A1 Oct. 5, 2023

(51) Int. Cl.

| | |
|---|---|
| ***E02F 3/00*** | (2006.01) |
| ***E02F 3/38*** | (2006.01) |
| ***E02F 3/43*** | (2006.01) |
| ***E02F 9/20*** | (2006.01) |

(52) U.S. Cl.

CPC ..... *E02F 3/388* (2013.01); *E02F 3/431* (2013.01); *E02F 9/2033* (2013.01)

(58) Field of Classification Search

None

See application file for complete search history.

(56) References Cited

U.S. PATENT DOCUMENTS

| | | | | |
|---|---|---|---|---|
| 7,963,716 | B2 | 6/2011 | Yamasaki | |
| 9,062,435 | B2 | 6/2015 | Hylen | |
| 9,719,228 | B2 * | 8/2017 | Kumbhar | A01B 59/002 |
| 10,323,380 | B2 | 6/2019 | Sasaoka et al. | |
| 10,995,470 | B2 | 5/2021 | Vail et al. | |
| 2007/0235201 | A1 * | 10/2007 | Gharsalli | E02F 3/765 172/80 |
| 2010/0049410 | A1 * | 2/2010 | McKee | E02F 9/2012 701/50 |
| 2020/0248471 | A1 * | 8/2020 | Chambers | E04H 12/182 |

FOREIGN PATENT DOCUMENTS

| | | | |
|---|---|---|---|
| JP | 2004076325 | A | 3/2004 |
| JP | 2005133507 | A | 5/2005 |
| JP | 2013067967 | A | 4/2013 |
| JP | 3159451 | A1 | 4/2017 |

* cited by examiner

*Primary Examiner* — Paul B Yanchus, III

(57) ABSTRACT

An actuated shear pin includes an actuator and pin body coupled to the actuator. The actuator selectively configures the pin body in a locking configuration or a stowed configuration. In the locking configuration, the pin body is placed in a travel path of two components configured to move relative to each other, to inhibit such relative movement. In the stowed configuration, the pin body is out of the travel path, thereby allowing the two components to move relative to each other.

20 Claims, 6 Drawing Sheets

CONTROL SYSTEM FOR ACTUATED PINS

TECHNICAL FIELD

This disclosure relates generally to industrial machines, and, more specifically, to actuated shear pins and control systems and methods for selectively inhibiting relative movement of portions of the industrial machine using such pins.

BACKGROUND

Industrial machines, such as earth moving machines, construction machines, mining machines, or the like, can include movable work implements. For instance, a wheel loader can include a bucket disposed at a distal end of a lift arm. The lift arm is movable relative to a frame of the wheel loader, e.g., to lift and lower the bucket, and the bucket can be pivoted, e.g., to receive or dump a payload during material loading and transferring operations.

For desired operational performance, regular servicing or maintenance of industrial machines is performed. For inspection or maintenance of the lift arm and/or components associated with the lift arm, e.g., actuators, fluid transfer lines, of the like, the lift arm is generally maintained in a raised position. For instance, an operator may hold a lever in a position that actuates the lift arm to, and retains the lift arm in, the raised position. However, the lift arm may be brought down if one or more actuators malfunction, or if a person unwittingly moves the lever during inspection/maintenance. Some conventional maintenance routines include using an additional machine, such as a crane or service truck to retain the lift arm in the raised position. However, some wheel loaders are used in underground applications, where the use of additional machines is not practical or desired.

U.S. Pat. No. 10,995,470 describes an improvement to manually retaining a lift arm in a raised position. Specifically, the '470 patent relates to a service pin assembly for a machine that includes a service pin and a tray for retaining the service pin. The tray of the '470 patent can be manually moved between a first position that facilitates storage of the service pin with the machine and a second position that facilitates an engagement of the service pin with a lift arm of the machine and a frame of the machine to restrict relative movement therebetween.

While the '470 patent describes an improvement to conventional systems that required manual retention of a lever in an actuated position, the '470 patent requires a mechanic, operator or other individual to physically access the service pin and tray, e.g., by climbing onto the machine or approaching the location of the pin via a boom lift or the like. Physically accessing the pin can expose the individual to moving parts of the machine, which can be hazardous.

Example implementations of the present disclosure are directed toward overcoming the deficiencies described above. For instance, aspects of the present disclosure are directed to actuated shear pin designs and methods of using actuated shear pins to facilitate locking of components on industrial machines.

SUMMARY

In an aspect of the present disclosure, an example machine includes a frame; one or more lift arms coupled to the frame and movable relative to the frame; a sensor; an actuated pin assembly comprising a locking pin actuatable between a stowed configuration and a locking configuration; and a controller. The controller is configured to perform actions including: with the actuated pin assembly in the stowed configuration, receiving a signal to lock the one or more lift arms relative to the frame; receiving sensor data from the sensor; determining, based on the sensor data, a position of the one or more lift arms relative to the frame; and based at least in part on the position corresponding to a locking position of the one or more lift arms, actuating the locking pin from the stowed configuration to the locking configuration.

In another aspect of this disclosure, an example method of locking out an implement on a machine includes: receiving a signal to lock the implement relative to the machine; receiving sensor data from a sensor on the machine; determining, based on the sensor data, a position of the implement relative to the machine; and based at least in part on the position corresponding to a locking position of the implement, actuating a locking pin from a stowed configuration to a locking configuration.

In yet another aspect of this disclosure, an example machine includes a frame; an implement coupled to the frame and movable relative to the frame; an actuated pin assembly comprising a locking pin actuatable between a stowed configuration and a locking configuration; and a controller. The controller is configured to perform actions including: with the actuated pin assembly in the stowed configuration, receiving a signal to lock the one or more lift arms relative to the frame; determining a position of the implement relative to the frame; based at least in part on the position corresponding to a locking position of the implement, generating a signal to actuate the locking pin from the stowed configuration to the locking configuration; and actuating the locking pin from the stowed configuration to the locking configuration based at least in part on the signal.

DETAILED DESCRIPTION

This disclosure generally relates to industrial machines, such as wheel loaders, with movable implements. The improvements and techniques described herein can result in improved safety for workers tasked with maintaining and/or servicing such machines. Although the present disclosure is described in connection with industrial machines, the systems and techniques described herein may be useful in other implementations in which it is desirable to impede relative motion of mechanical components. Wherever possible throughout this disclosure, the same reference numbers will be used through the drawings to refer to the same or like features.

Figure 1:
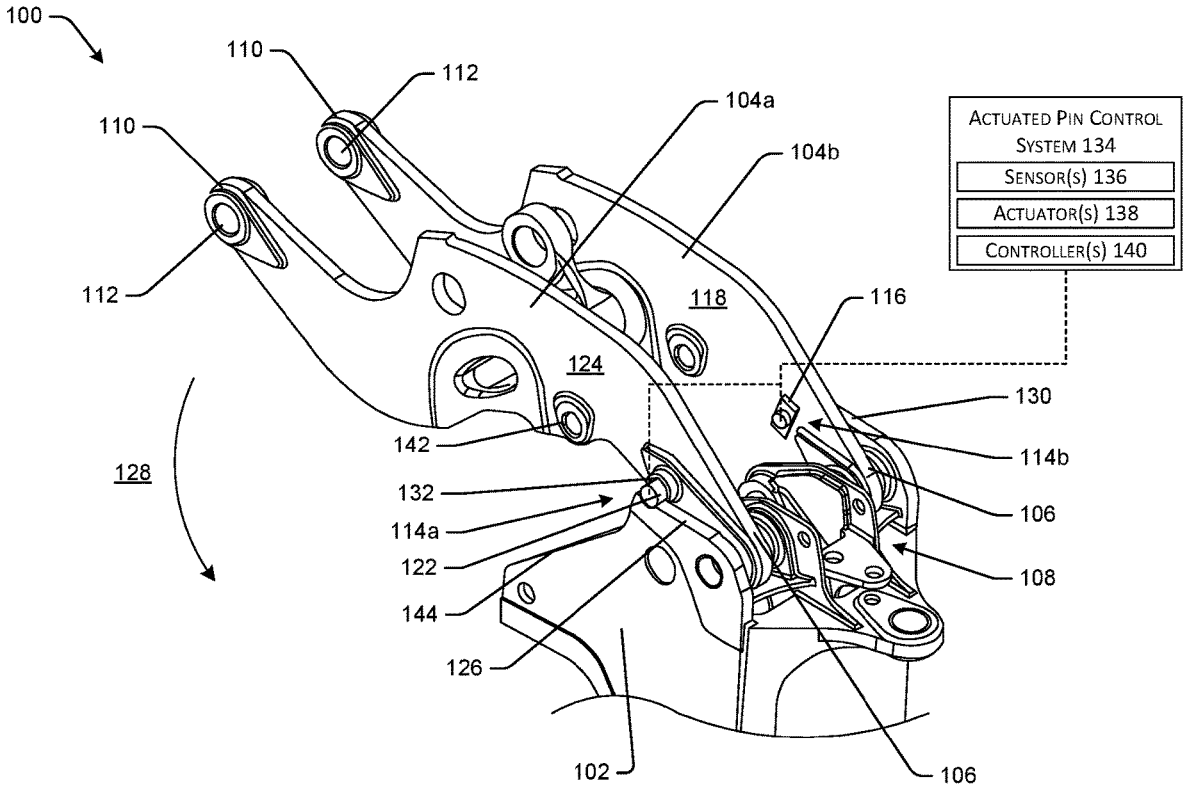
FIG. 1 is a perspective view of a portion of an industrial machine including an actuated pin assembly, in accordance with an example of the present disclosure.

FIG. 1 illustrates a lift arm assembly 100 for use with an industrial machine. The industrial machine may be configured to perform work associated with a particular industry, e.g., underground mining, open pit mining, construction, excavation, or the like. Without limitation, the industrial machine may be an excavator, an underground mining loader, a load haul dump loader, a wheel loader, a skid steer loader, or any other machine having a lift arm assembly.

More specifically, the lift arm assembly 100 includes a frame 102, a first lift arm 104*a* and a second lift arm 104*b* (collectively, the lift arms 104) coupled to, and movable relative to, the frame 102. For clarity, only a portion of the frame 102 is illustrated. However, in examples, the frame 102 may support traction devices (e.g., wheels, tracks, or the like), one or more power sources (e.g., a hydrostatic drive, an engine, or the like), a cabin for housing an operator, and/or other features. In still further examples, the frame 102 shown in FIG. 1 may be a portion of a larger frame assembly that supports some or all of the features just described and/or other features. For instance, the frame 102 may include a number of plates, beams, weldments, or other components forming a rigid frame.

The lift arms 104 are coupled to the frame 102 and are configured to rotate relative to the frame 102, as noted above. More specifically, first ends 106 of the lift arms 104 are disposed to couple to the frame 102, e.g., at a pivot 108. The lift arms 104 move about the pivot 108 relative to the frame 102. The pivot 108 may be embodied as one or more pins, latches, and/or any other coupling that facilitates pivoting of the lift arms 104 relative to the frame 102. Second or distal ends 110 of the lift arms 104 are configured for attachment of a work implement, e.g., a bucket (not shown). For instance, in the example of FIG. 1, the distal ends 110 of the lift arms 104 are illustrated as including holes 112, which may be sized and positioned to accept a pin, latch, or other feature that secures the work implement, as is generally known in the art. Although two lift arms 104 are illustrated, more or fewer lift arms (e.g., a single lift arm) may be provided. Moreover, the shape, size, and other attributes of the lift arms 104 are for example only.

Although omitted from FIG. 1 for clarity, the lift arm assembly 100 may also include additional components, including but not limited to one or more lift arm actuators. Such lift arm actuators may operatively couple the lift arms 104 to the frame 102. As in conventional applications, the lift arm actuators may be extended or retracted to raise or lower the lift arms 104, e.g., relative to the frame 102. The lift arm assembly 100 may also include one or more implement actuators, e.g., to manipulate a bucket or other implement coupled to the lift arms 104. In examples, the lift arm actuator(s) and/or the implement actuator(s) may be hydraulic, electrostatic, electromagnetic, compressed air, or any type of actuator. Also in examples, the lift arm actuator(s) and/or the implement actuator(s) may be controlled autonomously, remotely, by an operator, e.g., via an operator interface associated with the machine, or otherwise.

As also illustrated in FIG. 1, the lift arm assembly 100 includes a first actuated pin assembly 114*a* and a second actuated pin assembly 114*b* (collectively, the actuated pin assemblies 114). The first actuated pin assembly 114*a* is associated with the first lift arm 104*a* and the second actuated pin assembly 114*b* is associated with the second lift arm 104*b*. As discussed further herein, the pin assemblies 114 are configured to selectively impede motion of the lift arms 104 relative to the frame 102. More specifically, as illustrated in the example of FIG. 1, the second actuated pin assembly 114*b* is mounted, via a mount 116, to an inboard surface 118 of the second lift arm 104*b*. Although not visible in FIG. 1, the first actuated pin assembly 114*a* may be similarly mounted to an inboard surface (e.g., facing the inboard surface 118 of the second lift arm 104*b*) of the first lift arm 104*a* via a mount like the mount 116. The mount 116 is depicted schematically, and may include any features or components that facilitate mounting of the second actuated pin assembly 114*b* to the second lift arm 104*b*. Without limitation, the mount 116 may be bolted or welded to the second lift arm 104*b*, and the second actuated pin assembly 114*b* may be coupled to the mount 116 using bolts, welding, or other conventional fasteners or fastening mechanisms.

The actuated pin assemblies 114 are secured to the lift arms 104, respectively, at a position to selectively inhibit movement of the lift arms 104 relative to the frame 102. More specifically, and as detailed further below with reference to FIGS. 2-4, the actuated pin assemblies 114 are configured to selectively actuate between a stowed configuration and a locking configuration. Specifically, in the stowed configuration, the actuated pin assemblies 114 are disposed so as to not impede movement of the respective lift arms 104, relative to the frame 102. In contrast, in the locking configuration, a portion of the actuated pin assemblies 114 is disposed to prevent some movement of the respective lift arms 104 relative to the frame 102.

In the example of FIG. 1, the first actuated pin assembly 114*a* is configured in the locking configuration. In this configuration, a pin body 122 of the first actuated pin assembly 114*a* extends beyond an outboard surface 124 of the first lift arm 104*a*. In this position, the pin body 122 is disposed to limit travel of the first lift arm 104*a* relative to the frame 102. Specifically, the pin body 122 is disposed to contact a surface 126 of the frame 102 to prevent movement of the first lift arm 104*a* relative to the frame 102 in a direction indicated by an arrow 128. In the example of FIG. 1, the surface 126 may include a saddle or other contoured feature that generally corresponds to an outer surface of the pin body 122. In other examples, a hole or other feature may be disposed in the frame 102, with the pin body 122 being disposed in the hole to prevent relative movement of the frame 102 and the lift arm 104*a*, as detailed herein. Although obscured in the view of FIG. 1, the second actuated pin assembly 114*b* may be similarly configured in a locking configuration, e.g., in which a pin body associated therewith extends outboard of the lift arm to contact a surface 130 (or opening or other feature) of the frame 102. In the illustrated example, the actuated pin assemblies 114, in the locking configurations, retain the lift arms 104 in a raised position.

In the stowed position (not illustrated in FIG. 1, but demonstrated in FIG. 3, discussed below), the pin body 122 is positioned so as to not contact the surface 126 of the frame 102. In the illustrated example, the pin body 122 may be retracted into an opening 132 formed through the first lift arm 104*a*. Accordingly, the first actuated pin assembly 114*a* is disposed at least partially in the opening 132 and at least a portion of the first actuated pin assembly 114*a*, e.g., at least a portion of the pin body 122, extends from the opening 132 in the locking configuration. Although obscured by the mount 116, the second lift arm 104*a* may have an opening similar to the opening 132, with portions of the second actuated pin assembly 114*b* being disposed in and/or configured to extend from the opening. Details of this arrangement are described further below, including with reference to FIGS. 3 and 4.

FIG. 1 also shows an actuated pin control system 134 associated with the lift arm assembly 100. The actuated pin control system 134 is shown schematically, and includes one or more sensors 136, one or more actuators 138, and one or more controllers 140. Generally, the actuated pin control system 134 facilitates actuation of the actuated pin assemblies 114, e.g., between the stowed and locked configurations, discussed above. Aspects of the actuated pin control system 134 may be integrated into the individual actuated pin assemblies 114 and/or may be remote from the actuated pin assemblies 114. In some examples, the actuated pin control system 134 facilitates remote actuation of the actuated pin assemblies 114, e.g., between the stowed and locking configurations. Remote actuation obviates the need for a worker or operator to physically place or adjust the pin body, thereby improving safety outcomes.

In more detail, the sensor(s) 136 may include one or more sensors associated with the lift arms 104, the frame 102, and/or the actuated pin assemblies 114. For instance, and without limitation, the sensor(s) 136 can include position and/or state sensors that sense a position or presence of the lift arms 104 relative to the frame 102. In examples, data from the sensor(s) 136 can indicate that the lift arms 104 are in a raised position or a lowered position, e.g., relative to the frame 102. In other examples, the sensor(s) 136 can include position and/or state sensors that sense a position or state of the actuated pin assemblies 114. Without limitation, data from the sensor(s) 136 can indicate whether the actuated pin assemblies 114 are in the locking configuration or in the stowed configuration. Additional examples of the sensor(s) 136 are discussed further herein.

The actuator(s) 138 are configured to selectively actuate components of the lift arm assembly 100. For instance, the actuator(s) 138 can include lift arm actuators, e.g., coupled to the frame 102 and to the lift arms 104, that cause the lift arms 104 to move relative to the frame 102, e.g., between a raised position and a lowered position. The actuator(s) 138 can also include actuators associated with the actuated pin assemblies 114, e.g., actuation of which configures the actuated pin assemblies 114 in the stowed or locking configurations. As noted above, and although not illustrated in FIG. 1, the lift arm assembly 100 can also include one or more implement actuators, e.g., to move a bucket or other implement relative to the lift arms 104.

The controller(s) 140 are configured to control aspects of the lift arm assembly 100. The controller(s) 140 may include a central processing unit, a suitable memory component, various input/output peripherals, and other components typically associated with machine controllers. The controller(s) 140 may include programs, algorithms, data maps, etc., associated with operation of the aspects of the machine. In examples, the controller(s) 140 may be configured to receive information from multiple sources, such as, for example, the sensor(s) 136, the actuator(s) 138, and/or a machine operator for instance, via a control device or user interface element. In some instances, the controller(s) 140 may include a dedicated electronic control module (ECM) or other type of onboard computer of the machine. In some embodiments, aspects of the controller(s) 140 may be integrated into the sensor(s) 136 and/or the actuator(s) 138, e.g., such that the sensor(s) 136 and/or the actuator(s) 138 may be configured to perform operations discussed herein. In this case, the controller(s) 140, or certain aspects thereof, may be eliminated.

In examples detailed further below, including below with reference to FIG. 6, the controller(s) 140 may include logic to receive a request to secure the lift arm assembly 100, e.g., a request from an operator to ready the lift arm assembly 100 for maintenance or inspection. For instance, as noted above, it may be desirable to secure or "lock" the lift arms 104 in a raised position, e.g., relative to the frame 102. The controller(s) 140 may also include functionality to receive sensor data from the sensor(s) 136. For example, the controller(s) 140 can receive sensor data from the sensor(s) 136 indicative of a position or state of the lift arms 104 and/or the actuated pin assemblies 114. Based on data from the sensor(s) 136, the controller(s) 140 can determine that the lift arms 104 are in a raised position, and thus capable of being locked out. The controller(s) 140 can also include logic to generate and/or send one or more signals to control the actuator(s) 138. For example, when the controller(s) 140 determine, from the sensor data, that the lift arms 104 are in the raised position, the controller(s) 140 may control actuators associated with the actuated pin assemblies 114 to configure the actuated pin assemblies 114 in the locking configuration. The controller(s) 140 may also include logic to determine that the actuated pin assemblies 114 are in the locked configuration, e.g., based on data from one or more of the sensor(s) 136 associated with the actuated pin assemblies 114. Additional functionality associated with the controller(s) 140 is detailed further herein.

As will be appreciated from the foregoing, the controller(s) 140 may be configured to control the actuated pin assemblies 114, e.g., remotely. As a result, the arrangement and techniques described herein can obviate the need for an operator, mechanic, or other individual to physically place a shear pin to lock out the lift arms 104. Accordingly, aspects of this disclosure provide improved safety outcomes.

The lift arm assembly 100 illustrated in FIG. 1 is for example only; modifications are contemplated. For example, although each of the lift arms 104 is illustrated in FIG. 1 as including one of the actuated pin assemblies 114, in other examples only a single instance of the actuated pin assemblies may be provided. For instance, when the first lift arm **104*a* and the second lift arm 104*b* are fixed to each other, a single instance of the actuated pin assemblies 114, e.g., only the first actuated pin assembly 114*a*, may be sufficient to retain both lift arms 104** in the raised position.

Moreover, individual of the lift arms 104 may include more than one instance of the actuated pin assemblies 114. For example, multiple instances of the actuated pin assemblies 114 may be disposed along a length of the lift arms 104, each configured to secure the lift arms 104 at a different position relative to the frame 102. With specific reference to FIG. 1, although not illustrated, an additional instance of the actuated pin assemblies 114 may be disposed to cooperate with holes 142 relatively closer to the distal end 110 of the first lift arm **104*a*. In this example, the additional instance of the actuated pin assemblies may include a pin body that contacts an additional surface 144 of the frame 102. As will be appreciated, this example contact will retain the first lift arm 104*a* in a different position, relative to the frame 102**, than that illustrated.

Moreover, although the actuated pin assemblies 114 are illustrated as being secured to the lift arms 104, in other examples, the actuated pin assemblies 114 may be coupled to the frame 102. In such examples, the pin body 122, in the locking configuration, may be contacted by a surface of the lift arms 104. Stated differently, in the locking configuration, the pin body 122 may be disposed in a travel path of the lift arms 104, e.g., a travel path relative to the frame 102.

Moreover, although the actuated pin assemblies 114 are disposed to selectively allow/prevent movement of the lift arms 104 relative to the frame 102, other instances of the actuated pin assemblies 114 may be used to prevent other relative movement. Without limitation, the actuated pin assemblies 114 may be disposed to selectively prevent movement of an implement relative to the lift arms 104, of articulating frame portions, and/or of any two components configured to move relative to each other. As will be appreciated with the benefit of this disclosure, the features and techniques described herein may be useful to prevent relative movement of any mechanical components in many applications. Aspects of this disclosure are not limited to use with lift arms on machines.

Figure 2:
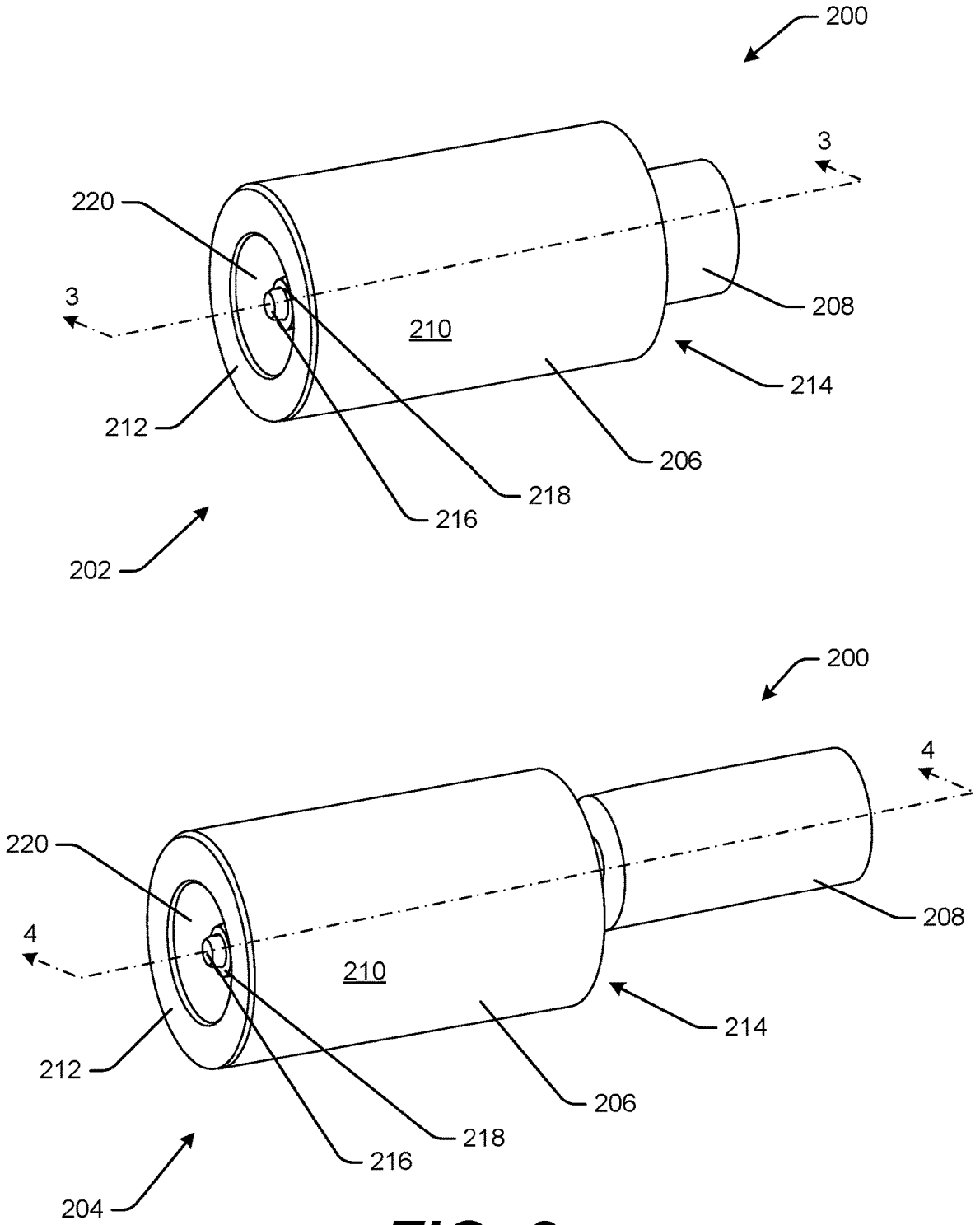
FIG. 2 includes a perspective view of an actuated pin assembly, for use with a machine, in each of a stowed configuration and a locking configuration, in accordance with aspects of the present disclosure.

FIG. 2 is a perspective view showing an actuated pin assembly 200 in more detail. The actuated pin assembly 200 may be one of the actuated pin assemblies 114, for example. More specifically, FIG. 2 shows the actuated pin assembly 200 in a stowed configuration 202 and in a locking configuration 204, generally corresponding to the stowed and locking configurations, respectively, discussed above in connection with FIG. 1.

As illustrated in FIG. 2, the actuated pin assembly 200 includes a pin body 206, which may correspond to the pin body 122. The pin body 206 is illustrated as having a generally cylindrical, exterior surface 210, e.g., a sidewall, extending between a first end 212 and an opposite, second end 214 (obscured in FIG. 2). Although the exterior surface 210 is cylindrical in FIG. 2, the exterior surface 210 may be differently shaped, e.g., depending on the application. For instance, the exterior surface 210 may have one or more flat, arcuate, or other surface contours. In some examples, a contour of the exterior surface 210 may be configured to cooperate with a surface or feature on a part to be "locked" in the locking configuration 202. However, the cylindrical sidewall 210 may be preferred in some examples, for instance, because the pin body 206 will have the same configuration regardless of a rotational orientation of the pin body 206.

Figure 3:
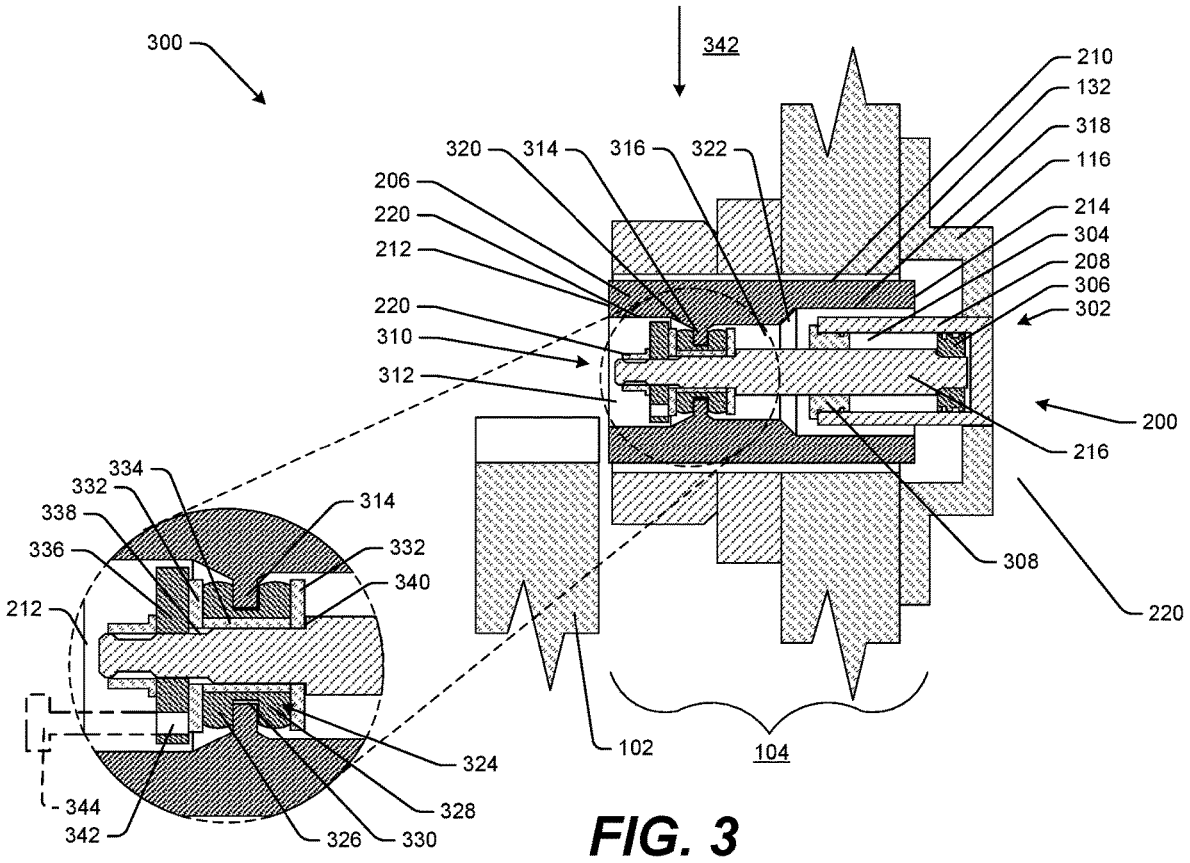
FIG. 3 is a cross-sectional view of the actuated pin assembly of FIG. 2, taken along the section line 3-3 in FIG. 2, in accordance with aspects of this disclosure.
Figure 4:
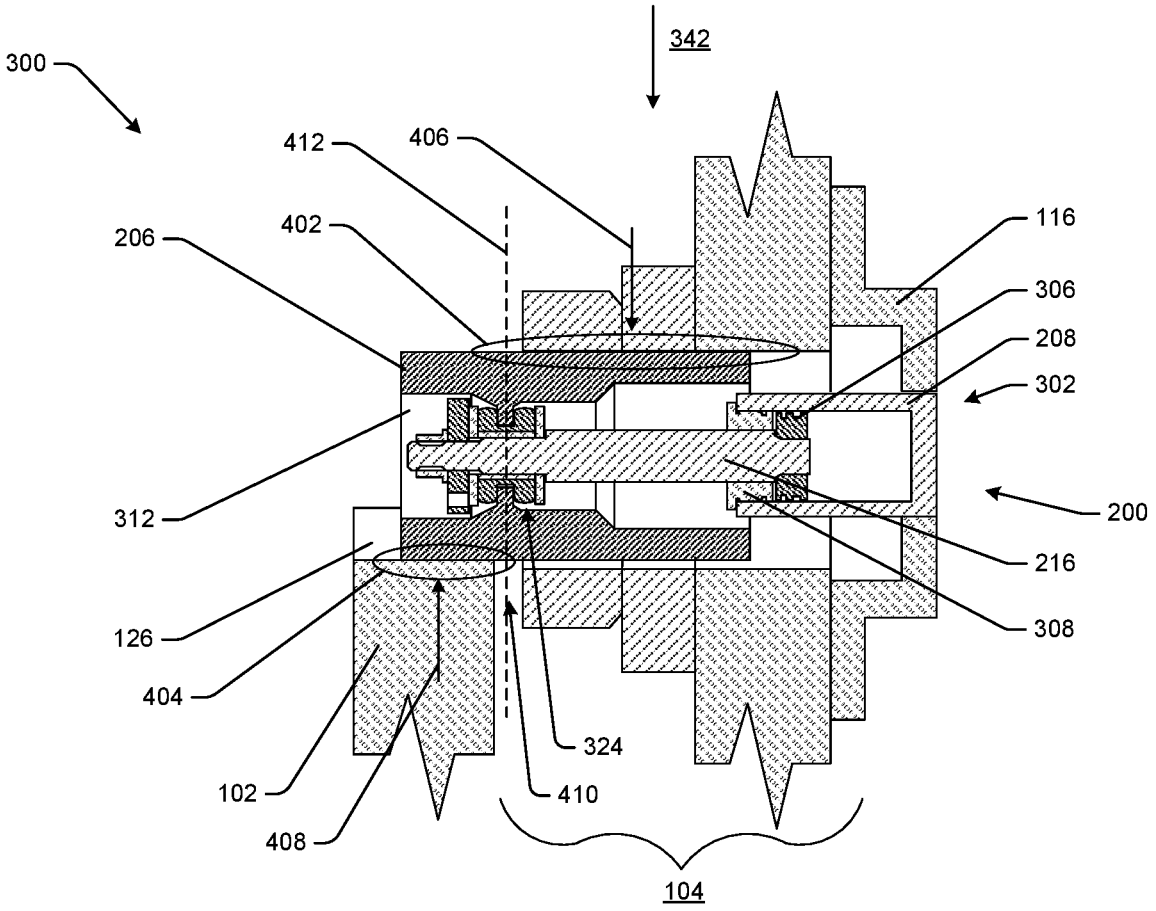
FIG. 4 is a cross-sectional view of the actuated pin assembly of FIG. 2, taken along the section line 4-4 in FIG. 2, in accordance with aspects of this disclosure.

In the example of FIG. 2, and better illustrated in FIGS. 3 and 4, the pin body 206 is coupled to a movable member, embodied as a piston rod 216. The piston rod 216 is disposed to move relative to a fixed or stationary member, embodied as a cylinder 208. More specifically, the piston rod 216 is movable relative to the cylinder 208 between a retracted position and an extended position. In the example of FIG. 2, a distal end of the piston rod 216 is threaded, and a nut 218 retains the pin body 206 on the piston rod 216. An axial bore 220 is formed in the first end 212 of the pin body 206, and the distal end of the piston rod 216 and the nut 218 are disposed in the first bore 220. This arrangement is detailed further in FIG. 3, although the arrangement is also for illustration only. In one alternative example, the bore 220 may not be present, e.g., the nut 218 may be secured to the first end 212 of the pin body 206. The threaded nut 218 is only one example of a retaining fastener that can be secured to the piston rod 216 to secure the pin body 206 to the piston rod 216. Other retaining fasteners may include pins, clips, collars, and/or the like.

In the stowed configuration 202, the piston rod 216 is retracted, relative to the cylinder 208. Accordingly, the pin body 206 is also in a retracted position. As detailed further below with reference to FIG. 3, in the stowed configuration 202, the pin body 206 is disposed to surround the cylinder 208, e.g., by receiving a body of the cylinder 208 in an axial bore formed in the second end 214. In the locking configuration 204, when the piston rod 216 is extended, the pin body 206 is also extended from the cylinder 208. In the stowed configuration 202, as discussed above, the pin body 206 is disposed out of the path of travel of a first component (e.g., the frame 102) that moves relative to a second component (e.g., the lift arms 104) so as to not impede such relative motion. As also discussed above, in the locking configuration 204 the pin body 206 is disposed in the path of travel, e.g., to contact a surface of the first component. This contact limits (or prevents) relative movement of the components, thereby "locking" the components in a desired position.

FIGS. 3 and 4 show the interaction of the actuated pin assembly 200 with components of a machine. More specifically, FIG. 3 is cross-sectional view 300 taken along section line 3-3 in FIG. 2, and FIG. 4 is a cross-sectional view 400 taken along section line 4-4 in FIG. 2. In each of FIGS. 3 and 4, additional environment for the actuated pin assembly 200, e.g., portions of the frame 102 and the lift arm 104, is shown, also in cross-section. Moreover, in FIGS. 3 and 4, the elements introduced above with reference to, and labelled in, FIG. 2, are referred to, and labelled, using the same reference numerals.

The cross-sectional view 300 of FIG. 3 corresponds to the stowed configuration 202. As shown, the pin body 206 is disposed in the opening 132 extending through the lift arm 104. Here, the lift arm 104 is illustrated as including three pieces, although more or fewer components could form the thickness of the lift arm 104 through which the opening 132 is formed. The pin body 206 is secured to the piston rod 216, and the piston rod 216 is disposed to move relative to the cylinder 208. FIG. 3 also shows, schematically, that the cylinder 208 is coupled to the lift arm 104 via the mount 116.

In more detail, the cylinder 208 and the piston rod 216 comprise portions of an actuator 302, which may be one of the actuator(s) 138 discussed above. In more detail, the cylinder 208 at least partially defines a volume 304. A piston 306, to which the piston rod 216 is attached, is disposed in the volume 304. A piston seal 308 seals the volume 304. As in conventional actuators, the piston 306 is configured to slide, in an axial direction, relative to an inner surface of the cylinder 208 in response to a force applied on a side of the piston. In the illustrated example, the actuator 302 is a hydraulic actuator, and hydraulic fluid is selectively forced into the volume 304 to cause actuation of the piston 306. Hydraulic fittings, supply lines, and/or the like are not shown, for clarity. Moreover, although FIGS. 3 and 4 embody the actuator 302 as a hydraulic cylinder, other actuators are contemplated. Without limitation, the actuator 302 may be a compressed air actuator, an electromechanical actuator, a drive screw, or the like.

As also shown in FIG. 3, the pin body 206 includes an axial opening 310. The axial opening 310 has a varied profile, e.g., formed by a number of different diameters, providing a contoured interior surface 312 of the pin body. For example, proximate the first end 212, the axial opening 310 defines the bore 220 discussed above, which may be a first bore. The axial opening 310 also defines a protrusion 314, an intermediate section 316, and a second bore 318 proximate the second end 214. As illustrated, the axial opening 310 also defines a first transitional section 320, between the first bore 220 and the protrusion 314, and a second transitional section 322, between the intermediate section 316 and the second bore 318. Thus, the interior surface 312 of the pin body includes, from the first end 212 of the pin body 206 to the second end 214, the bore 220, the first transitional section 320, the protrusion 314, the intermediate section 316, the second transitional section 322, and the second bore 318. Functionality and attributes of the varied sections are described in more detail, below. Moreover, the sections, shapes, and sizes of the axial opening 310 are for example only. In examples, some or all of the sections may be combined, omitted, and/or differently sized/shaped. As detailed further herein, the axial opening 310 may be configured to provide clearance between the interior surface 312 and components of the actuator 302, except at a cushioned interface.

FIG. 3 also shows additional aspects of the actuated pin assembly 200. For example, a resilient member 324 (shown more clearly in the magnified insert of FIG. 3) is disposed on the piston rod 216, e.g., proximate a distal end of the piston rod 216. The resilient member 324 cooperates with the protrusion 314 of the axial opening 310. More specifically, the resilient member 324 includes a first radial protrusion 326 spaced from a second radial protrusion 328. The first radial protrusion 326 and the second radial protrusion 328 form an annular channel 330 therebetween. As shown in FIG. 3, the resilient member 324 is disposed, in the axial direction, between washers 332. Moreover, a sleeve 334 is disposed between the piston rod 216 and the resilient member 324. In other examples, one or both of the washers 332 may be replaced by other members configured to retain the resilient member 324 in a fixed position on the piston rod 216, e.g., in the axial dimension, or one or both of the washers 332 may be omitted entirely. As described further below, the washers 332 may also apply a force in the axial direction to the resilient member, e.g., to retain the resilient member at least partially compressed in the axial direction.

The resilient member 324 may be a compressible member, e.g., made of a polymer, rubber, or the like. In some implementations, the resilient member 324 may be embodied as an isolation mount, e.g., a mushroom mount. Isolation mounts are conventionally used to accommodate displacement, damp vibration, reduce shock, or the like. In this example, the resilient member may be formed as two pieces, e.g., a first piece including the first radial protrusion 326 and a second piece including the second radial protrusion 328. Moreover, two or more of the first radial protrusion 326, the second radial protrusion 328, the washers 332 and/or the sleeve 334 may be formed as one or more integral parts. As will be appreciated, isolation mounts may have different sizes, shapes, durometer or hardness characteristics, or the like, e.g., depending on the application. In the example, the washers 332 and/or the sleeve 334 may be harder than the resilient member 324. For instance, the washers 332 and/or the sleeve 334 may be metal or other relatively rigid materials.

In still further examples, the resilient member 324 may be embodied as one or more other components that provide for non-destructive displacement of the pin body 206 relative to the piston rod 216, as described herein. As noted above, polymeric members may provide for such displacement, but other types of resilient members 324, such as springs, spaced-apart magnets, e.g., spaced in the radial direction, or the like, also are contemplated.

The actuated pin assembly 200 also includes a disc 336 arranged closer to the distal end of the piston rod 216 than the resilient member 324. Specifically, the disc 336 includes an axial opening sized to retain the outer surface of the piston rod 216, and the disc 336 is positioned between the resilient member 324 and the nut 218. In some examples, the disc 336 may be substantially cylindrical and the axial opening of the disc 336 may also be round. However, in other examples the disc 336 and/or the piston rod 216 may include anti-rotation features. In the example illustrated in FIG. 3, the piston rod 216 includes a number of flats 338 forming a non-circular profile for the piston rod 216 proximate the threaded end. The axial opening in the disc 336 has a contour to match the non-circular profile of the piston rod 216, e.g., at straight or planar segments corresponding to the flats 338. Accordingly, the flats 338 may require that the disc 336 be oriented on the piston rod 216 in one or more specific ways. Moreover, the flats 338 ensure that the disc 336 does not rotate relative to the piston rod 216. For example when the nut 218 is tightened on the piston rod 216, the disc 226 will not rotate relative to the piston rod 216, e.g., if there is friction between the nut 218 and the disc 336. Although the example of FIG. 3 includes the flats 338 on the piston rod 216 and corresponding flats on the axial opening of the disc 336, other arrangements and configurations may be used to reduce inhibit rotation of the disc 336 relative to the piston rod 216. For instance, any non-circular profiles, a keyed arrangement, or the like, may be used.

During assembly, the resilient member 324, washers 332, and the disc 336 are placed over the distal end of piston rod 216, e.g., with one of the washers 332 contacting a step 340 formed on the piston rod 216. As will be appreciated, the step 340 may be formed from a reduction in the diameter of the piston rod 216, although in other examples the step 340 may be formed via a collar or other diameter-altering structure secured to an outer surface of the piston rod 216. The step 340 provides an axial positioning of the resilient member 324 and other features just discussed. Specifically, the step 340 provides a rigid surface that inhibits further axial displacement, relative to the piston rod 216. Threading the nut 218 onto the piston rod will cause the disc 336 to move in the axial direction, thereby applying a force to compress the resilient member 324 in the axial direction, e.g., between the step 340 and the nut 218. The compression caused by tightening the nut 218 will cause the first and second radial protrusions 326, 328 to "pinch" the protrusion 314 of the axial opening 310 of the pin body 206. In the illustrated embodiment, the sleeve 334 may be sized, and sufficiently stiff, to maintain an axial distance between the washers 332 and prevent further tightening of the nut 218. In some examples, the nut 218 may be tightened to a predetermine torque, e.g., based on properties of the resilient member 324, a loading of the resilient member 324, and/or the like.

As noted above, the flats 338 or similar feature(s) may be provided to prevent relative rotation of the disc 336 to the piston rod 216 during tightening of the nut 218. However, as will be appreciated, the disc 336 and the piston rod 216 may rotate, e.g., together, during tightening of the nut 218. Accordingly, aspects of this disclosure also include a tool interface, via which rotation of the disc 336, e.g., relative to the pin body 206, may be prevented. In the example of FIG. 3, a threaded hole 342 is formed through the disc 336. The threaded hole 342 is offset from a central axis of the piston rod 216. The threaded hole 342 is configured to selectively receive a threaded bolt 344. With the threaded bolt 344 threaded into the threaded hole, a torque may be applied to the nut 218, to tighten the nut 218 as discussed above, and a tool, such as a wrench, may be coupled to a head of the threaded bolt to apply a force that counters the torque applicated to the nut 218. In this example, once the nut is sufficiently tightened, the threaded bolt 344 can be removed.

In this example, the threaded bolt 344 is sufficiently long to extend past the first end 212 of the pin body 206, e.g., for ready engagement by the tool. However, in other examples the bolt head may be disposed in the first bore 220 and may be accessed by a socket or similar tool. Similarly, the nut 218 may be tightened using a socket wrench, e.g., because the nut 218 is disposed in the first bore 220. Other tool interfaces and/or tool interface arrangements also are contemplated. For example, multiple instances of the threaded hole 342 may be formed through the disc 336, e.g., circumferentially spaced from each other. In this example, a tool may be configured to contact each of a plurality of bolts disposed in the threaded openings. Without limitation, the tool may have a plurality of surfaces configured to engage with the bolts. In other examples, instead of the threaded opening, the disc 336 can be replaced with a protrusion, e.g., that is engageable with a tool (such as a socket wrench) or with a differently-shaped opening that can receive a different tool, e.g., an Allen key or the like.

In the illustrated example, the portions of the axial opening 310 provide for coupling of the piston rod 216, e.g., via the protrusion 314 and the resilient member 324. However, at other axial positions of the pin body 206, the interior surface 312 is sized to be radially spaced from the piston rod 216 and other components associated with the piston rod 216. For example, the disc 336 is spaced from the first bore 222, the washers 332 are spaced from the first transitional section 320 and the intermediate section 316. The piston rod 216 and the cylinder 208 also are spaced from the interior surface 312. As detailed further below, minimizing contact of the pin body 206 and the piston rod 216 to the interface at the protrusion 314 and the resilient member 324 may prevent damage to both the actuator 302 and the pin body 206, e.g., by controlling how, and where, contact is made.

In the example of FIG. 3, in the stowed configuration, at least a portion of the cylinder 208 is disposed in the second bore 318. Stated differently, the pin body 206 acts as a sleeve that receives at least a portion of the cylinder therein in the stowed configuration. As noted above, the outer surface of the cylinder 208 is radially spaced from the interior surface 312 of the pin body 206, e.g., at the second bore 318. This arrangement reduces an overall length of the actuated pin assembly 200. For example, this reduced length may facilitate incorporation of the actuated pin assembly 200 into existing machines and/or work implements, such as the lift arm assembly 100 with minimal modification or clearance requirements.

In the example of FIG. 3, the mount 116 couples the cylinder 208 to the side of the lift arm 104 such that the pin body 206 is substantially entirely disposed in the opening 132. The opening 132 and the pin body 206 are sized to provide a clearance fit, e.g., such that the exterior surface 210 of the pin body 206 is spaced from the inside of the opening 132. Also in the stowed configuration shown in FIG. 3, the pin body 206 does not extend from the opening 132, e.g., in the axial direction, into a path of travel of the frame 102. More specifically, FIG. 3 also shows a portion of the frame 102, and in the illustrated configuration, the lift arm 104 is free to move relative to the frame 102, e.g., generally in the direction of an arrow 342, which corresponds in direction to the arrow 128 of FIG. 1.

FIG. 4 shows the actuated pin assembly 200 in the locking configuration. In this example, the piston rod 216 is extended, e.g., relative to the cylinder 208. More specifically, the piston 306 is moved relatively closer to the piston seal 308. In this configuration, the pin body 206 extends into the path of travel of the frame 102 (e.g., relative to the lift arm 104). As will be appreciated, the exterior surface 210 of the pin body 206 contacts the surface 126 of the frame 102 to prevent continued motion of the lift arm 104, e.g., in the direction of travel represented by the arrow 342. As noted above, although the surface 126 is shown as an upper surface or saddle associated with the frame 102, in other examples the pin body 206 may engage with an opening or hole formed in the frame 102. Use of the opening or hole may require greater positioning precision before actuating the pin body 206 to the locking configuration, but may also have the benefit of restricting substantially all relative movement of the lift arm 104 relative to the frame 102. Moreover, although the lift arm 104 is illustrated as including a hole through which the pin body 206 extends, in other examples the hole may be replaced with different openings and/or different surfaces. For example, and without limitation, the pin body 206 may be configured to contact a surface of the lift arm 104 that includes a saddle or other surface features, like the surface 126.

In the example of FIG. 4, the actuated pin assembly 200 may be subjected to large shear loads. Specifically, with the pin body 206 extended into the travel path of the frame 102 the pin body 206 will experience a first shear force at a first region 402 and a second shear force at a second region 404. The first shear force at the first region 402 results from contact of the pin body 206 with the lift arm 104 and is represented in FIG. 4 by a first arrow 406. The second shear force at the second region 404 results from contact of the pin body 206 with the frame 102 and is represented in FIG. 4 by a second arrow 408. Because the first shear force and the second shear force are in generally opposite directions and are spaced from each other, e.g., in a direction parallel to the axis of the actuated pin assembly 200, components of the actuated pin assembly 200 may be subjected to a bending or twisting resulting from the first and second shear forces. However, in examples of this disclosure, the resilient member 324 is configured to offset, e.g., absorb, these forces. For instance, the resilient member 324 may allow for movement of the pin body 206 relative to the piston rod 216 and/or other components of the actuator 302, while preventing the interior surface 312 of the pin body 206 from contacting components of the actuated pin assembly 200. Stated differently, the resilient member 324 may allow for a pliable connection between the pin body 206 and the actuator 302 that absorbs the relative displacement until the pin body 206 fully contacts the surface 126. This contact results in substantially all loads being transferred from the pin body 206 to the contact surface 126, e.g., without being transferred to the piston rod 216. Stated differently, the resilient member 324 decouples the cylinder from the pin load, by absorbing displacement caused by offsets resulting from clearance between the pin body 206 and the opening 132, mechanical tolerances, and/or the like. In some alternative examples a rigid connection may be used instead of the resilient member 324, although such a rigid connection may completely transfer loads to the piston rod 216 and/or other components of the actuated pin assembly 200. Such transfer of loads may lead to premature failure of the piston seal 308, undesirable wear of the piston 306, bending of the piston rod 216, or other problems that could prevent proper functioning of the actuated pin assembly 200.

In addition to using the resilient member 324 at the connection of the pin body 206 and the actuator 302, the inventors have found that the positioning of the resilient member 324, e.g., in the axial direction, may also provide benefits. As shown in FIG. 4, a gap 410 is disposed between the frame 102 and the lift arm 104. As will be appreciated, the gap 410 provides clearance between the frame 102 and the lift arm 104 to allow the two components to move relative to each other, as discussed herein. In the locking configuration shown in FIG. 4, the resilient member 324 is generally aligned with the gap 410, e.g., along a line 412. In this position, the resilient member 324 may be better positioned to absorb the forces at the first region 402 and the second region 404. However, the actuated pin assembly 200 is not limited to the resilient member 324 being aligned with the gap 410. Without limitation, in other examples, the resilient member 324 may be offset from the line 412 and still function to absorb the displacement at the first region 402 and/or the second region 404 and allow the pin body 206 to bear the loads without transferring the loads to the piston rod 216.

Figure 5:
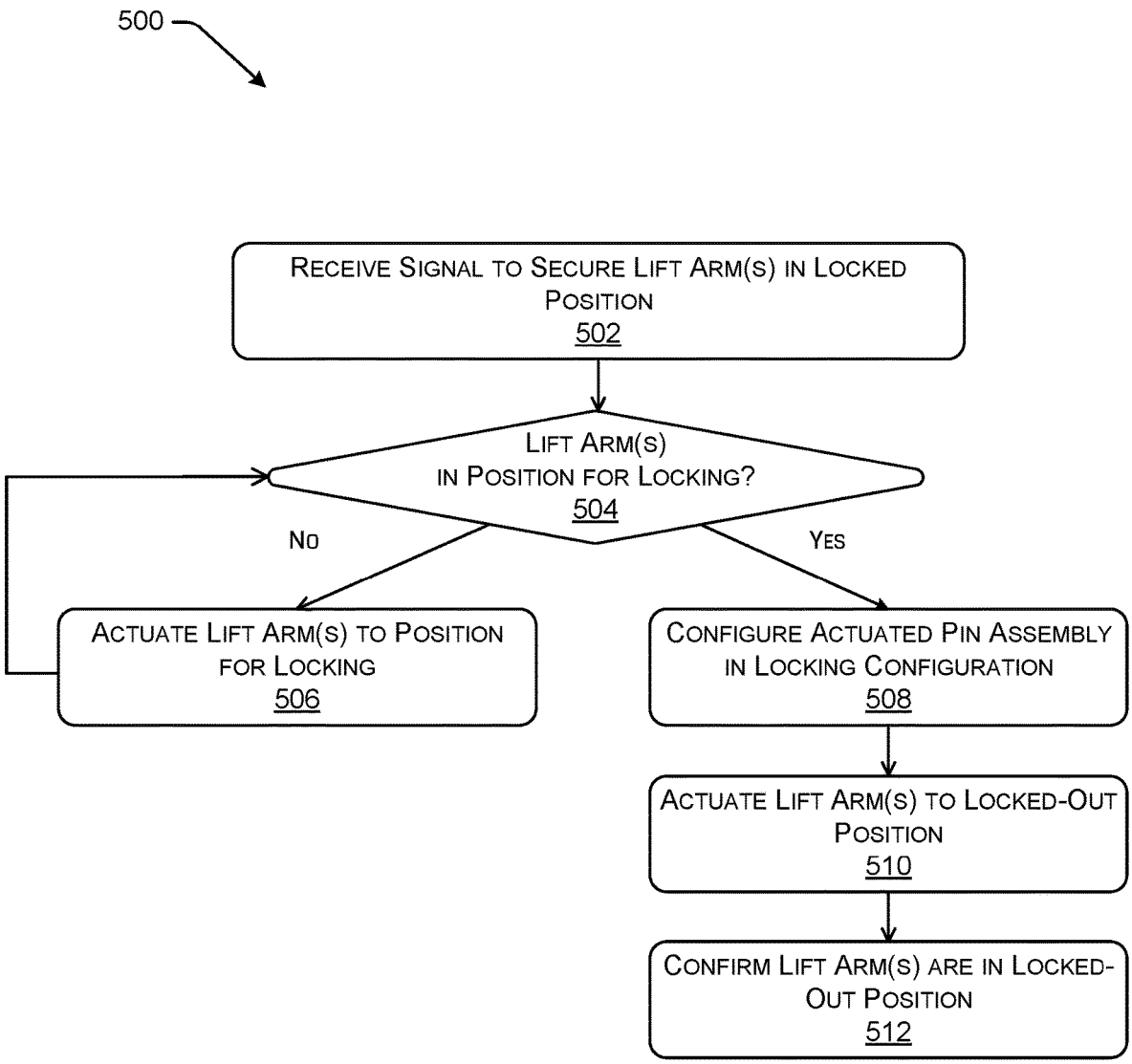
FIG. 5 is a flow chart representative of a process for controlling an industrial machine including an actuated pin assembly, in accordance with aspects of this disclosure.

FIG. 5 is a flow chart corresponding to an example process 500 of using an actuated pin assembly, like the actuated pin assemblies 114, 200 discussed above. For example, and without limitation, some or all of the process 500 can be implemented by the actuated pin control system 134, including the sensor(s) 136, the actuator(s) 138, and/or the controller(s) 140. Moreover, aspects of the process 500 can be implemented by the machine control system 600 (detailed below). However, the process 500 is not limited to being performed by the actuated pin control system 134, the control system 600, or components thereof. Moreover, although the process 500 is discussed with reference to the components discussed above, the systems and techniques described herein are not limited to use with such systems. The features and benefits of the process 500 may be realized using any number of pins or other lockout devices capable of locking a first mechanical component relative to a second mechanical component.

At an operation 502, the process 500 includes receiving a signal to secure one or more lift arms in a locked position. For example, an operator or maintenance worker may determine that a machine including the lift arms 104 should be repaired, inspected, or the like, and may enter a command, e.g., via a switch, button or other user input, indicating that the lift arms 104 should be "locked out." The user interface may generate a signal corresponding to the command, and transmit the signal to the controller(s) 140 in some examples. In still further examples, the signal to enter the lock out mode may be generated by the vehicle, e.g., in response to a fault or the like. Without limitation, the signal may be generated in response to determining that a component of a machine to which the lift arms are coupled has malfunctioned, broken, or the like. Stated differently, the signal may be generated in response to any unsafe condition at the machine or involving the machine.

At an operation 504, the process 500 includes determining whether the lift arm(s) are in a position for locking. As detailed herein, the lift arms 104 may be locked, e.g., secured relative to the frame 102 in a raised position. The operation 504 may include receiving a signal confirming that the lift arms 104 are at (or above) the raised position at which they are locked out. For example, the operation 504 can include receiving a signal, e.g., from the sensor(s) 136 or the actuator(s) 138 confirming that the lift arms 104 are raised above a predetermined height, past a predetermined angle, or the like. The sensor(s) 136 can also include presence/absence sensors, which may confirm that the frame 102 would not obstruct actuation of the pin assembly to the locking configuration, as detailed herein. In still further examples, the operation 504 may include a visual inspection, e.g., by an operator or maintenance worker, that the lift arms 104 are raised above a predetermined height. In this example, the operator/worker may be required to provide an input, e.g., via a user interface, confirming that the lift arms 104 are sufficiently positioned.

If, at the operation 504 it is determined that the lift arms are not in a position for locking, at an operation 506 the process 500 includes actuating the lift arm(s) to the position for locking. For example, the operation 506 can include automatically, e.g., via a command to the actuator(s) 138 associated with the lift arms 104, moving the lift arms 104 from the current position to the locking position. In still further examples, the operation 504 may include instructing an operator associated with the machine to move the lift arms to the locking position, with the operator moving the lift arm(s), e.g., via controls on the machine or remote controls. As shown, the operations 504 and 506 are performed as a loop, e.g., until the lift arm(s) are determined to be in the position for locking.

If, at the operation 504 it is determined that the lift arms are in the position for locking, at an operation 508 the process 500 includes configuring the actuated pin assembly in the locking configuration. Specifically, the actuator 302 of the actuated pin assembly 200 may be actuated to position the piston/piston rod in the extended position shown in FIG. 4. In the extended position, the pin body 206 is disposed in the relative path of the travel between the frame 102 and the lift arms 104. An example of the locking configuration is also illustrated at 204 in FIG. 2. As will be appreciated, with the actuated pin assembly 200 in the locking configuration, lowering of the lift arms 104 is inhibited by the extended pin body 206, thereby "locking out" the lift arms 104. With the lift arms 104 locked out, repair, maintenance, and/or other services can be performed on the lift arm assembly 100 and/or other parts of the machine, with the lift arms 104 safely locked out. In other examples, the lift arms 104 may be locked out using the actuated pin assembly 200 when the machine is to be unattended.

In some examples, the operation 508 can also include confirming that the actuated pin assembly is in the locking configuration. Without limitation, the actuator 302 may include a sensor, e.g., a position sensor, state sensor, or presence sensor, that confirms that the piston rod 216 is in the extended position. Moreover, one or more sensor(s), such as a presence sensor or state sensor and which may be the sensor(s) 136, may be disposed on the lift arm 104 and/or the frame 102 to confirm that the pin body 206 is in an extended position, corresponding to the locking configuration 204. In still further examples, the operation 508 can include requiring a user input confirming, e.g., via visual inspection, that the locking pins are extended.

At an operation 510, the process 500 includes actuating the lift arm(s) to a locked-out position. For example, and as noted above, the position for locking configured at the operation 504 may be a position that provide clearance for the pin assembly to actuate. In examples described herein, the position for locking may be above a position at which the lift arms are actually locked out. At the operation 510, the lift arms 104 are actuated to the locked out position. For example, the locked out position may be a position at which the lift arms 104 contact the extended pin body 206. Without limitation, the locked out position may be the position shown in FIG. 4, e.g., in which both the frame 102 and the lift arm 104 contact the pin body 206.

In some examples, implementation of the operation 510 can include reducing power to actuator(s) associated with performing the operation 510. For instance, the process 500 may further including reducing power to lift arm actuators to the receiving a signal to return the lift arm to an operational state. For example, a current to a solenoid associated with the actuator(s) 138 may be reduced, flow of hydraulic fluid or pressure of hydraulic fluid may be reduced, or the like, to limit impact of the lift arms with the extended pin assemblies, e.g., to prevent excessive force to the pin that could result in damage or the like.

At an operation 512, the process 500 optionally includes confirming that the lift arm(s) are in the locked-out position. For example, the operation 510 receiving a signal, e.g., from the sensor(s) 136 or the actuator(s) 138 confirming that the lift arms 104 are arranged proximate a predetermined height associated with the locked-out position, proximate a predetermined angle associated with the locked-out position, or the like. The sensor(s) 136 can also include presence/absence sensors, which may confirm that the lift arms 104 are in a position relative to the frame 102 corresponding to the locked-out position. In still further examples, the operation 504 may include a visual inspection, e.g., by an operator or maintenance worker, that the lift arms 104 are in the proper, locked-out position. In this example, the operator/worker may be required to provide an input, e.g., via a user interface, confirming that the lift arms 104 are sufficiently positioned for locking out.

In still further examples, the operation 512 can include determining that actuators(s) associated with the lift arms 104 have met a resistance consistent with being locked out. For example, and without limitation, a feedback loop may be provided to determine that, despite a command signal to actuate the lift arms 104 the lift arms 104 are not moving, e.g., based on sensor data, changes in pressure and/or electrical properties, or the like. For example, should a sensor determine that, in response to the command to move the lift arms 104, that the lift arms move beyond the locked-out position, e.g., drop to a position below the locked-out position, an error may be detected. The error may be conveyed to an operator, e.g., via a user interface, such that the error may be diagnosed. Without limitation, the error may be associated with a malfunctioning sensor, a broken component, e.g., a broken pin body 208, and/or any other condition that may prevent locking-out the lift arms 102 (or positively detecting that the lift arms 104 are locked out).

Although not illustrated in FIG. 5, a process for "unlocking" the lift arms 104, e.g., returning the lift arms to normal functioning, also is contemplated. For example, such a process can include receiving a signal to return the lift arm to an operational state. For example, the operation can include receiving a user input, e.g., from an operator or maintenance worker, that the machine should return to normal operation. The machine may include a user interface to facilitate such user input, and the user interface may be configured to generate a signal indicative of the desire to return the machine to functional.

In response to receiving the signal, the process can include configuring the actuated pin assembly in a stowed configuration. For example, such an operation can include actuating the actuator 302 to retract the piston rod 216, as in the example of FIG. 3. FIG. 2 also shows the actuated pin assembly 200 in the stowed configuration 202. As detailed herein, in the stowed configuration, the pin body 206 is disposed in the opening 132 formed through the lift arm 104 or some other position that does not inhibit relative movement of the lift arm 104 and the frame 102. Also in some examples, prior to the configuring of the actuated pin assembly in the stowed configuration, the lift arm 104 may be moved relative to the frame 102, e.g., to relieve any pressure on the pin assembly. Without limitation, the lift arm(s) may be moved to the position for locking discussed above in the operation 504 prior to the actuated pin assembly being configured in the stowed configuration.

The operation can also include confirming that the actuated pin assembly 200 is in the stowed configuration. Without limitation, the actuator 302 may include a sensor, e.g., a position sensor, that confirms that the piston rod 216 is in the retracted position. Moreover, one or more sensor(s), such as a presence sensor or state sensor and which may be the sensor(s) 134, may be disposed on the lift arm 104 and/or the frame 102 to confirm that the pin body 206 is in the retracted position, corresponding to the stowed configuration 202.

In some examples, the actuated pin assembly 200 may be confirmed to be in the stowed configuration. Without limitation, the actuator 302 may include a sensor, e.g., a position sensor, that confirms that the piston rod 216 is in the retracted position. Moreover, one or more sensor(s), such as a presence sensor or state sensor and which may be the sensor(s) 136, may be disposed on the lift arm 104 and/or the frame 102 to confirm that the pin body 206 is in the retracted position, corresponding to the stowed configuration 202.

Figure 6:
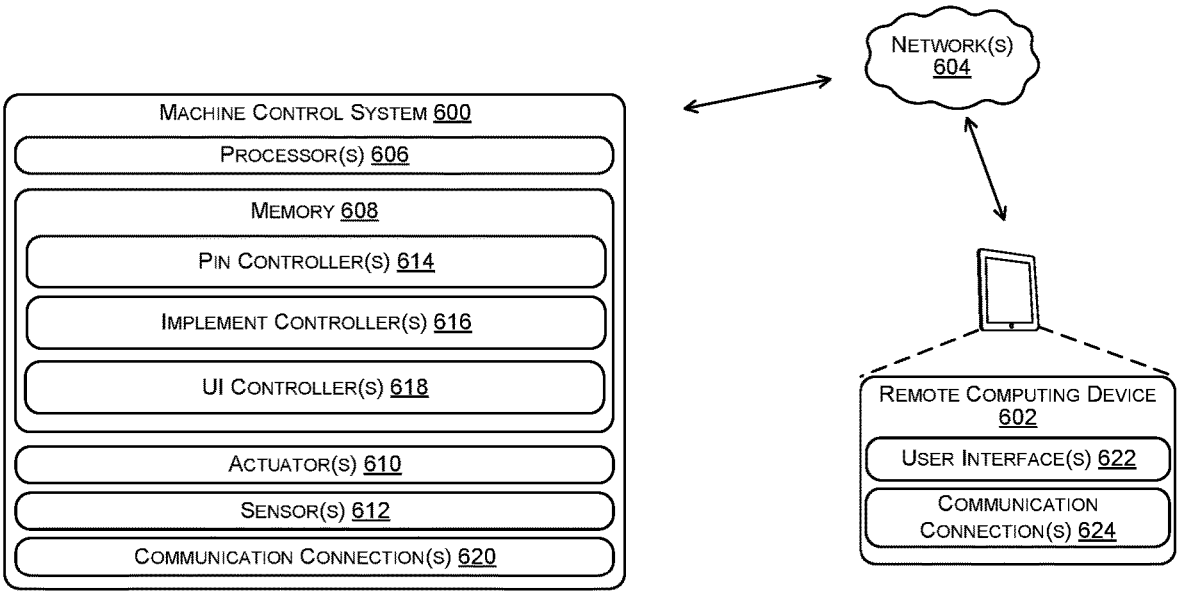
FIG. 6 is system diagram for implementing aspects of pin control in an industrial machine, in accordance with aspects of this disclosure.

FIG. 6 is a block diagram of portions of a machine control system 600. The machine control system 600 is for example only, and may be associated with a machine including the frame 102 and lift arms 104, as discussed herein.

As illustrated in FIG. 6, the machine control system 600 may be communicatively coupled to a remote computing device 602, e.g., via one or more network(s) 604.

The machine control system 600 is illustrated as including one or more processors 606, memory 608 communicatively coupled to the processor(s) 606, one or more actuators 610, and one or more sensors 612. In the illustrated example, the memory 608 stores one or more pin controllers 614, one or more implement controllers 616, and one or more UI (user interface) controllers 618. Although these systems and components are illustrated as, and will be described below as, separate components, functionality of the various systems may be attributed differently than discussed. Moreover, fewer or more systems and components may be utilized to perform the various functionalities described herein. Furthermore, though depicted in FIG. 6 as residing in memory 608 for illustrative purposes, it is contemplated that the controller(s) may additionally, or alternatively, be accessible to the control system 600 (e.g., stored on, or otherwise accessible by, memory remote from the control system 600).

The processor(s) 606 can be any suitable processor capable of executing instructions to process data and perform operations as described herein. By way of example and not limitation, the processor(s) 606 can comprise one or more Central Processing Units (CPUs), Graphics Processing Units (GPUs), or any other device or portion of a device that processes electronic data to transform that electronic data into other electronic data that can be stored in registers and/or memory. In some examples, integrated circuits (e.g., ASICs, etc.), gate arrays (e.g., FPGAs, etc.), and other hardware devices can also be considered processors in so far as they are configured to implement encoded instructions.

Memory 608 may be non-transitory computer-readable media. Memory 608 can store an operating system and one or more software applications, instructions, programs, and/or data to implement the methods described herein and the functions attributed to the various systems. In various implementations, the memory can be implemented using any suitable memory technology, such as static random-access memory (SRAM), synchronous dynamic RAM (SDRAM), nonvolatile/Flash-type memory, or any other type of memory capable of storing information. The architectures, systems, and individual elements described herein can include many other logical, programmatic, and physical components, of which those shown in the accompanying figures are merely examples that are related to the discussion herein.

The actuator(s) 610 may be any or all of the actuator(s) 138 described herein. For example, and without limitation, the actuator(s) 610 can include actuators associated with pin assemblies, e.g., the actuator 302, actuators for moving implements, like the lift arms 104, and/or any other actuators.

The sensor(s) 612 may be any of the sensors described herein, including but not limited to the sensor(s) 136. Without limitation, the sensor(s) 612 can include sensors configured to determine a state of an object, such as the pin assemblies, the lift arms 104, and/or the like. The sensor(s) 612 can include presence/absence sensors, state sensors, position sensors, rotary position sensors, vision sensors, magnetic sensors, and/or the like.

The pin controller(s) 614 are configured to control aspects of actuated pin assemblies, such as those detailed herein. For instance, the pin controller(s) 614 can generate and send signals to an actuator, such as the actuator 302, to selectively configure the pin assembly in the extended (locking) position or the retracted (stowed) position. Without limitation, the pin controller(s) 614 can receive sensor data, e.g., from the sensor(s) 612, signals, e.g., from the remote computing device 602 and/or other information, and control actuation of the pin assemblies based thereon. Without limitation, the pin controller(s) 614 may include the actuated pin control system 134, detailed above.

The implement controller(s) 616 are configured to control aspects of mechanical components of a machine, such as the lift arms 104. In some examples, the implement controller(s) 616 are configured to control aspects of the actuator(s) 610, e.g., to cause the lift arms to move, to control power to the actuator(s), and/or the like.

The UI controller(s) 618 are configured to control aspects of a user interface, such as a user interface associated with the machine, including but not limited to a user interface 622 associated with the remote computing device 602. For example, the UI controller(s) 618 may be configured to cause a display accessible by an operator to present a graphical user interface to facilitate user operation and/or user input. Without limitation, the UI controller(s) 618 may generate graphical user interfaces that present alerts to a user, that instruct a user to take some action(s), e.g., to move the lift arms to the position for locking and/or the locked-out position, that provide a status to the user, e.g., "locked-out" or normal operation, and/or provide other information. Without limitation, the UI controller(s) 618 may also facilitate receipt of user inputs, e.g., via the user interface(s) 622 and/or a user interface on the machine.

As also illustrated in FIG. 6, the machine control system 600 includes one or more communication connections 620 and the remote computing device 602 includes one or more communication connections 624. The communication connections 620, 624 may facilitate communication between the machine control system 600 and the remote computing device, e.g., via the network. In other examples, the communication connection(s) 620 may be configured to facilitate communication between the components of the machine control system 600 and/or other remote systems. The communication connection(s) 620 can include or facilitate wired and/or wireless connection for signal, data, and/or information transmission and/or reception.

IN some examples, one or more of the controllers 614, 616, 618 may be electronic controllers that operate in a logical fashion to perform operations such as execute control algorithms, store and retrieve data, and other similar operations. The controllers may additionally include any other components required for running an application including but not limited to access memory, secondary storage devices, processors, and the like. The memory and secondary storage devices may be in the form of read-only memory (ROM), random access memory (RAM) or integrated circuitry that is accessible by the controller. Various other circuits may be associated with the machine control system 600 including but not limited to power supply circuitry, signal conditioning circuitry, driver circuitry, and other types of circuitry.

As used herein, the term "controller" is meant in its broadest sense to include one or more controllers, processors, central processing units, and/or microprocessors that may be associated with the system 600, and that may cooperate in controlling various functions and operations of the components included in the system 600 and/or described herein. The functionality of the controllers may be implemented in hardware and/or software without regard to the functionality. The controllers and/or the system 600 may rely on one or more data maps, look-up tables, neural networks, algorithms, machine learning algorithms, and/or other components relating to the operating conditions and the operating environment of system 600. The data maps noted above may include a collection of data in the form of tables, graphs, and/or equations to maximize the performance and efficiency of system 600, the controllers, and their operations.

The network 604 may be a local area network ("LAN"), a larger network such as a wide area network ("WAN"), or a collection of networks, such as the Internet. Protocols for network communication, such as transmission control protocol/Internet protocol (TCP/IP), may be used to implement network 124. Although examples are described herein as using a network 124 such as the Internet, other distribution techniques may be implemented that transmit information via memory cards, flash memory, or other portable memory devices. In still further examples, the network(s) 604 may include wired networks.

INDUSTRIAL APPLICABILITY

The present disclosure provides improved safety mechanisms, e.g., actuated pin assemblies, for use with conventional machines, such as industrial machines including lift arm assemblies. The actuated pin assemblies according to this disclosure provide improved safety over conventional lockout pins, resulting in reduced damage to equipment and/or safer working conditions, thereby reducing downtime for machines. The improvements and techniques described herein may be particularly useful on machines that are operated in confined spaces and/or that require frequent maintenance. For example, wheel loaders and/or other machines used in mines may require regular inspection, e.g., daily, weekly, or the like, and it may be difficult and/or inefficient to provide external machinery and/or equipment, such as cranes, to lockout portion of the machine. The present disclosure obviates the need for extra equipment to allow for safely securing portion of machine during inspection or the like. Moreover, despite the improvements detailed herein, the pin assemblies described herein may be used in conventional machines, e.g., with minimal to no modification to existing lift arm assemblies.

According to some implementations, a lift arm assembly 100 includes a lift arm 104 disposed to move relative to a frame 102. An actuated pin assembly 114, 200 is disposed on the lift arm 104 or the frame 102. The actuated pin assembly 114, 200 is actuatable between a stowed configuration 202 and a locking configuration 204. In the stowed configuration 202, the actuator pin assembly 114, 200 is disposed out of a travel path of the lift arms 104 relative to the frame 102, e.g., to allow for conventional operation of the lift arm assembly 100. In the locking configuration 204, a portion of the actuated pin assembly 114, 200, e.g., a pin body 206, is disposed in the travel path of the lift arms 104 relative to the frame 102, e.g., to prevent relative motion between the lift arms 104 and the frame. Actuation of the actuated pin assembly 114, 120 between the stowed configuration 202 and the locking configuration 204 may be accomplished remotely, e.g., via the actuated pin control system 134, thereby obviating the need for a worker to manually adjust or place the shear pin.

In examples described herein, the actuated pin assembly 114, 200 includes the pin body 206 coupled to an actuator 302. In examples, the actuator 302 may be a hydraulic actuator, e.g., including a cylinder 208 and a piston rod 216 movable relative to the cylinder 208, between a retracted position and an extended position. The pin body 206 is coupled to the piston rod 216 such that the actuated pin assembly 114, 200 is in the stowed configuration 202 with the piston rod 216 retracted and in the locking configuration 204 with the piston rod 216 extended. The coupling of the pin body 206 to the piston rod 216 can be made via the resilient member 324. The resilient member 324 allows for some movement of the pin body 206 relative to the piston rod 216, e.g., to absorb relative displacement of the pin body 206 to the frame 102 and/or the lift arm 104.

While aspects of the present disclosure have been particularly shown and described with reference to the examples above, it will be understood by those skilled in the art that various additional implementations may be contemplated by the modification of the disclosed machines, systems and methods without departing from the spirit and scope of what is disclosed. Such implementations should be understood to fall within the scope of the present disclosure as determined based upon the claims and any equivalents thereof.

What is claimed is:

1. A machine comprising:
a frame;
one or more lift arms coupled to the frame and movable relative to the frame;
a sensor;
an actuated pin assembly comprising a locking pin actuatable between a stowed configuration and a locked configuration; and
a controller configured to perform actions comprising:
with the actuated pin assembly in the stowed configuration, receiving a signal to lock the one or more lift arms relative to the frame,
receiving sensor data from the sensor,
determining, based on the sensor data, a position of the one or more lift arms relative to the frame,
based at least in part on the position corresponding to a locking position of the one or more lift arms, actuating the locking pin from the stowed configuration to the locked configuration,
with the locking pin in the locked configuration, restricting power to an actuator configured to actuate the one or more lift arms relative to the frame,
with power to the actuator restricted, actuating, via the actuator, the one or more lift arms to move relative to the frame such that the frame and the one or more lift arms are in contact with the actuated pin assembly.

2. The machine of claim 1,
wherein actuating the one or more lift arms to move relative to the frame such that the frame and the one or more lift arms are in contact with the actuated pin assembly comprises lowering the one or more lift arms relative to the frame, with power to the actuator restricted, and in a direction toward a surface on which the machine is disposed.

3. The machine of claim 1,
wherein the signal to lock the one or more lift arms relative to the frame is received by the controller via a network and from a device separate from the machine.

4. The machine of claim 1, further comprising a locking pin sensor, the actions further comprising:
receiving data from the locking pin sensor; and
determining, based on the data from the locking pin sensor and in response to actuating the locking pin, that the locking pin is in the locked configuration.

5. The machine of claim 4, wherein the locking pin sensor comprises a proximity switch configured to generate a signal as the locking pin sensor data when the locking pin is extended into the locked configuration.

6. The machine of claim 1, the actions further comprising:
based at least in part on the position not corresponding to the lock out position of the one or more lift arms, actuating the one or more lift arms relative to the frame toward the lock out position.

7. The machine of claim 6, further comprising a user interface, wherein:
the signal to lock the one or more lift arms is generated in response to a first user input at the user interface.

8. The machine of claim 7, wherein the actuating the locking pin from the stowed configuration to the locked configuration is at least in part in response to a second user input at the user interface.

9. A method of locking out an implement on a machine, the method comprising:
receiving a signal to lock the implement relative to the machine;
receiving sensor data from a sensor on the machine;
determining, based on the sensor data, a position of the implement relative to the machine;
based at least in part on the position corresponding to a locking position of the implement, actuating a locking pin of an actuated pin assembly from a stowed configuration to a locked configuration, the locked configuration being characterized by the locking pin extending laterally away from the actuated pin assembly, and
with the locking pin in the locked configuration, causing movement of the implement relative to a frame of the machine in a first direction, wherein:
such movement of the implement causes the locking pin to contact a surface separate from the actuated pin assembly, and
such contact impedes further movement of the implement in the first direction.

10. The method of claim 9,
wherein: such movement of the implement causes the machine and the implement to be in contact with the locking pin, and the surface comprises a surface of the frame.

11. The method of claim 10, further comprising:
with the locking pin in the locked configuration, restricting power to an actuator that actuates the implement relative to the machine, wherein the actuating the implement comprises actuating the implement with power restricted to the actuator.

12. The method claim 9, further comprising:

receiving data from a locking pin sensor; and determining, based on the data from the locking pin sensor and in response to actuating the locking pin, that the locking pin is in the locked configuration.

13. The method of claim 12, wherein the locking pin sensor comprises a proximity switch configured to generate a signal as the locking pin sensor data when the locking pin is extended into the locked configuration.

14. The method of claim 9, further comprising: based at least in part on the position not corresponding to the locking position of the implement, actuating the implement relative to the machine toward the locking position.

15. The method of claim 9, wherein the signal to lock the one or more lift arms is generated, by a device remote from the machine, in response to a user input at a user interface provided by the device.

16. The method of claim 9, wherein the actuating the locking pin from the stowed configuration to the locked configuration is at least in part in response to a user input at a user interface.

17. A machine comprising:

a frame;

an implement coupled to the frame and movable relative to the frame;

an actuated pin assembly comprising a locking pin actuatable between a stowed configuration and a locked configuration; and a controller configured to perform actions comprising:

with the actuated pin assembly in the stowed configuration, receiving a signal to lock the one or more lift arms relative to the frame, determining a position of the implement relative to the frame, based at least in part on the position corresponding to a locking position of the implement, generating a signal to actuate the locking pin from the stowed configuration to the locked configuration, actuating the locking pin from the stowed configuration to the locked configuration based at least in part on the signal, the locked configuration being characterized by the locking pin extending laterally away from the actuated pin assembly, and with the locking pin in the locked configuration, causing movement of the implement relative to the frame in a first direction, wherein:

such movement of the implement comprises lowering the locking pin onto a component of the machine separate from the actuated pin assembly, the component:

defining a surface configured to support the locking pin, and enabling unimpeded movement of the locking pin in a direction substantially perpendicular to the surface.

18. The machine of claim 17, wherein the actuated pin assembly further includes a cylinder, a piston configured to move in a first direction substantially parallel to a longitudinal axis of the locking pin within the cylinder, a piston rod attached to the piston, and a resilient member mated with the locking pin and disposed on the piston rod, the resilient member enabling movement of the locking pin, relative to the piston rod, in a second direction substantially perpendicular to the first direction.

19. The machine of claim 17, the actions further comprising: confirming that the frame and the implement are in contact with the locking pin by at least one of identifying a resistance to continued movement of the implement or receiving sensor data indicative of the contact.

20. The machine of claim 19, the actions further comprising: in response to the confirming, prohibiting operation of the implement.

* * * * *